United States Patent [19]

Koch

[11] 4,114,886

[45] Sep. 19, 1978

[54] GOLF CLUB

[76] Inventor: Bernard C. Koch, 2107 Brandywood Dr., Wilmington, Del. 19810

[21] Appl. No.: 728,305

[22] Filed: Sep. 30, 1976

[51] Int. Cl.[2] ..... A63B 53/00

[52] U.S. Cl. ..... 273/162 B; 273/164; 273/167 F; 273/167 J

[58] Field of Search ..... 273/32 H, 77 R, 162–175, 273/183 D, 194 R, 193 R; D34/5 CB, 5 GC, 5 GS, 5 GH; 33/180 R, 263, 283, 333, 334, 365, 391–394

[56] References Cited

U.S. PATENT DOCUMENTS

| | | | |
|---|---|---|---|
| D. 136,005 | 7/1943 | Armstrong | 273/167 D X |
| D. 183,091 | 6/1958 | Handzlik | D34/5 GH |
| D. 183,092 | 6/1958 | Handzlik | D34/5 GH |
| D. 198,383 | 6/1964 | Butler | D34/5 GC |
| D. 205,527 | 8/1966 | Andis | D34/5 GH |
| 3,242,582 | 3/1966 | Garrett | 273/32 H X |
| 3,309,089 | 3/1967 | Doyle | 273/32 H |
| 3,452,605 | 7/1969 | Markley | 33/391 X |

FOREIGN PATENT DOCUMENTS

| | | | |
|---|---|---|---|
| 237,686 | 8/1925 | United Kingdom | 273/164 |

OTHER PUBLICATIONS

"Golf Digest"; May 1965; p. 94.

"The Search for the Perfect Swing" by Cochran & Stobbs; 1968; p. 139.

*Primary Examiner*—Richard J. Apley

*Attorney, Agent, or Firm*—Hugh D. Jaeger; Warren A. Sturm

[57] ABSTRACT

A golf club having a shaft, a handle which affixes to one end of the shaft, and a club head which affixes to the other end of the shaft at an inverted right angle tee to the shaft. The club head is of the shape of a small trapezoid top portion symetrically positioned on top of a large trapezoid bottom portion. The shaft attaches to the top center of the small trapezoid top portion so that the weight of the club head is equally distributed over entire length of and circumferentially around the shaft. A plumb bob is contained within a cylinder assembly of the handle and is affixed to a removable top portion of the handle and is affixed to a removable top portion of the handle. A ball weighted string or string attached to a spring retracts the string into the cylinder when the removable top is replaced onto the handle.

5 Claims, 3 Drawing Figures

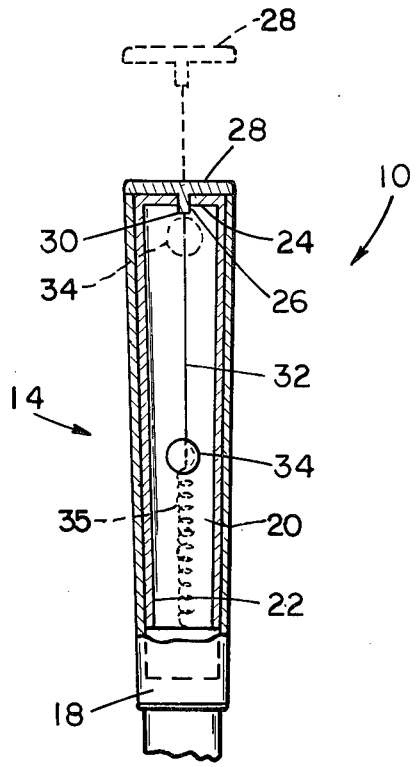
FIG. 1
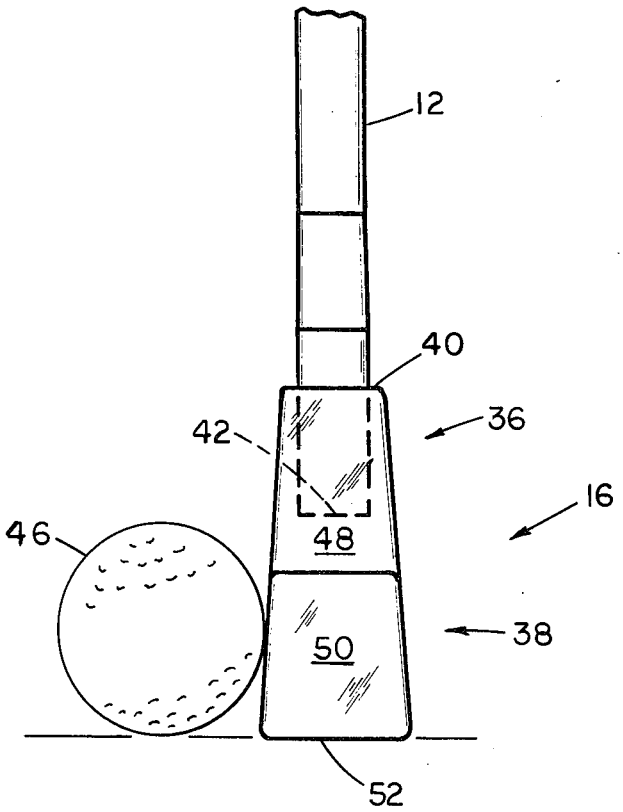

FIG. 4
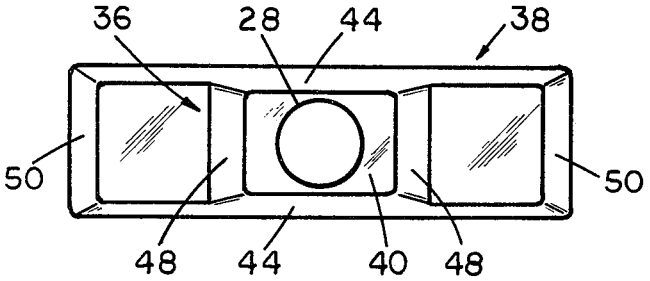
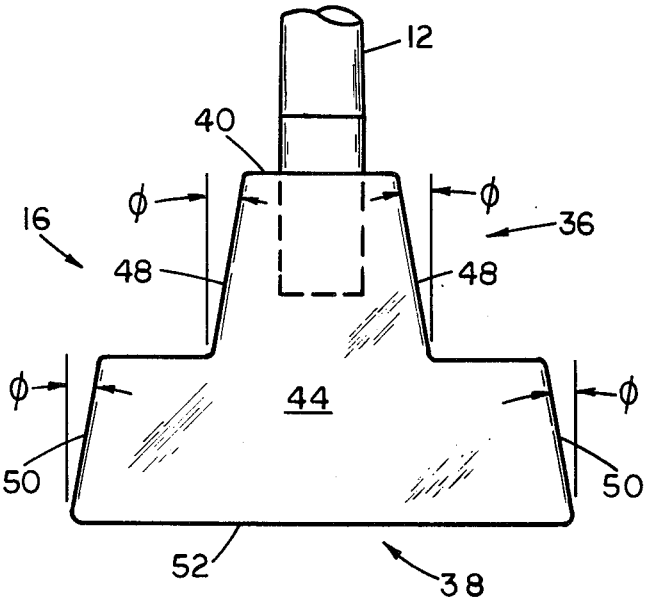
FIG. 3
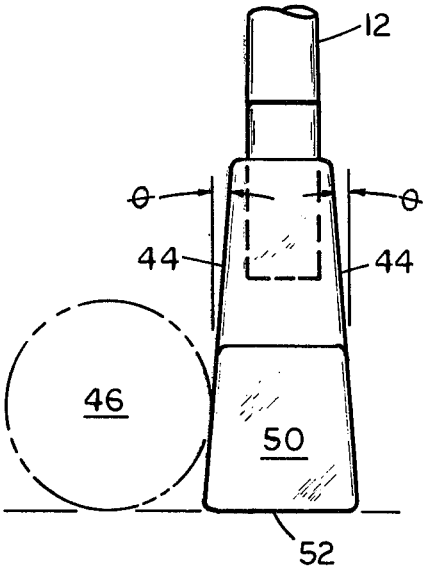
FIG. 2

GOLF CLUB

BACKGROUND OF THE INVENTION

1. Field of the Invention

The present invention relates generally to a golf club and more particularly pertains to a new and improved golf club, denoted in the art as a putter, wherein a club head which attaches to the golf club is geometrically symmetrical. The club head attaches to the shaft for equal weight distribution of the club head over the entire length and circumferentially around the shaft.

2. Description of the Prior Art

In the field of golf clubs, especially those denoted in the art as putters, it has been a general pratice to manufacturer golf clubs having club heads which are geometrically unsymmetrical and have unequal weight distribution with respect to the shaft. That is, the weight of the club head is not equally distributed over the entire length of the shaft or circumferentially around the shaft. For this reason, a golf ball that is struck by a putter does not necessarily follow a straight line due to uneven striking forces among other reasons. Also, it is difficult for an individual playing golf to use his steroscopic vision enabling him to perceive the depth of field thereby judging the distance and direction of travel of the golf ball to a target because conventional putters require the golfer to strike the ball to the golfer's left or right side instead of to his front where a natural line of sight utilizing both eyes will permit the golfer to judge distance optimally. Conventional putting requires the golfer to strike the ball to the golfer's left or right side instead of to his front where a natural line of sight utilizing both eyes will permit him to judge the distance optimally.

When striking a golf ball with a golf club, particularly those denoted in the art as putters, golf clubs have heads which are geometrically unsymmetrical with respect to the shaft not being attached to the center of the club head. This yields an uneven weight distribution over the entire length of the shaft resulting in an uneven striking force of the golf ball when the face of the club head comes into contact with the golf ball.

To have a golf ball follow a straight imaginary line from a resting place to a target such as a hole in a golf green, it is important to strike the golf ball at a proper angle. This is very difficult with a golf club, particularly a putter, having a nongeometrical golf club head attached to a shaft which results in an uneven weight distribution of the club head over the entire length of the shaft and an uneven striking of the golf ball.

Design patents issued to Armstrong, U.S. Pat. No. Des. 136,005 on July 20, 1943; Mackenzie, U.S. Pat. No. Des. 206,540, Dec. 27, 1966; and Dohan, U.S. Pat. No. Des. 226,617, Apr. 3, 1973 disclose various designs of golf club head configurations, particularly denoted in the art as putters, some of which have unsymmetrical heads attached at one end of the shaft.

This invention discloses a golf club having a geometrically symmetrical shapped club head which has equal distribution of the weight of the club head over the entire length of the shaft and circumferentially around the shaft.

SUMMARY

The present invention obviates the foregoing disadvantages of the prior art by providing a golf club, particularly denoted in the art as a putter, which has a geometrically symmetrical club head which attaches to the shaft of the golf club for equal weight distribution over the entire shaft and to allow even striking force of a golf ball. A plumb bob cylinder assembly is contained within the handle to determine the slope of the playing surface.

A significant feature and aspect of the invention is a golf club having a geometrical symmetrical club head thereby yielding an equal weight distribution over the entire length of and circumferentially around the shaft.

According to one embodiment of the present invention, there is provided a golf club having a shaft; a handle which attaches to one end of the shaft having positioned on top an upwardly removable top portion; a weighted plumb bob string attached to the removable top of the handle and contained within a cyclinder assembly of the handle; and an equally balanced and geometrically symmetrical shapped club head attached at a right angle to the other end of the shaft for equal weight distribution over the entire length of and circumferentially around the shaft.

Having briefly described one embodiment of the invention, it is a principal object thereof to provide a new and improved golf club. An object of the present invention is the provision of a golf club enabling a golfer to naturally perceive depth of field to accurately judge the distance and direction over which the ball will travel. The club allows a golfer to determine the correct striking power and direction of stroke to traverse the required distance to a predetermined target.

Another object is the provision of a symmetrically shaped club head which is attached to the shaft yielding an equal weight distribution over the entire length of the shaft and circumferentially around the shaft for an even distributed striking force of a face of the golf club head against a golf ball.

A further object of the invention is the provision of a plumb bob contained within a cylinder assembly of the handle and affixed to a removable top portion of the handle so that a golfer may plum the playing surface. A ball weighted string or string attached to a spring retracts the string into the the cylinder contained within the handle when the removable top is replaced onto the handle.

An additional object is the provision of a golf club which can be used by either a right handed or left handed golfer.

A still further object is a golf club, which although such is denoted and utilized in the art as a putter, a club which can also be utilized as a driver or an iron by using either end of the club head to strike a golf ball. The end of the golf club or the face of the golf club would be utilized as either a putter, iron, or driver depending upon the particular location of a golf ball and the respective target with respect to the surrounding terrian.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like references numerals designate like parts throughout the figures thereof and wherein FIG. 1 illustrates a perspective view of the invention with a shaft of the golf club broken away for purposes of illustration;

FIG. 2 is a side view of the invention;

FIG. 3 is an end view of the invention; and
FIG. 4 is a top view of the invention.

DESCRIPTION OF THE PREFERRED EMBODIMENTS

FIG. 1 illustrates a preferred embodiment of a perspective view of golf club 10, the invention, with shaft 12 broken away for purposes of illustration.

Handle 14 attaches to the top portion of shaft 12. Golf club head 16 attaches to the bottom portion of shaft 12 in a inverted tee right angle configuration. Shaft 12 can be any desired length to accommodate different physical heights of golfers. Handle 14 which attaches to shaft 12 can be any suitable leather or simulated leather handle which wraps onto the top portion of shaft 12 and is securely attached thereto by known methods in the art such as and for way of example, adhesive or glue. Upper internal hollow portion 18, a hand grip cavity, in shaft 12 accomodate a plumb bob cylinder assembly 20. Plumb bob cylinder assembly 20 should be narrow enough to fit into any any popular size hand grip cavity. Cylinder 22 slides into a internal hollow portion 18 of shaft 12 and is flush with the top of handle 14. Cylinder 22 has an enclosed top portion 24 with a hole 26 to accomdate removable top portion 28 having downward projection 30 which firmly fits into hole 26. Removable top portion 28 may be made of a material such as nylon and is of the same diameter as handle 14 so as to firmly fit flush with the outer diameter of handle 14 and strong enough to support the entire weight of the club 10 when placed upside down in a golf club bag.

String or chain 32 attaches to downward projection 30 of removable top portion 28 and is weighted with a small ball or weight 34 having such a diameter that it will not fit through hole 26 in enclosed top portion 24 of cylinder 22. The oversize circumference of weighted ball 34 compared to hole 26 retains the string in plumb bob cylinder assembly 20. In lieu of a weighted ball, a spring 35 shown in imaginary lines 35 shown in dashed lines could be attached from the bottom of cylinder 22 to string 32 retain and to retract the string 32. The spring 32 could be any retractable device such as a rubber band.

Club head 16 attaches to the bottom portion of shaft 12 and consists of a small trapezoid top portion 36 geometrically positioned on top of a large trapezoid bottom portion 38. Shaft 12 attaches to club head 16 by any of the known methods in the art such as and for way of example by extending and affixing shaft 12 into a hole in head 16 having a larger diameter then shaft 12 with a glue such as an expoxy resin compound. Head 16 is geometrically symmetrical in shape; that is, the small trapezoid top portion 36 is equal laterally positioned on large trapezoid bottom portion 38 such that the ends of small trapezoid top portion 36 are equally spaced from the ends of large trapezoid top portion 38. Also, the respective center lines of the front faces and ends of small trapezoid top portion 36 and large trapezoid bottom portion are "in line". Shaft 12 attaches to top 40 in hole 42 of the center of head 16 at a precise right angle of 90° of small trapezoid top portion 36 to insure perfect balance of the golf club 10 and equal weight distribution of club head 16 over the entire length of shaft 12 and circumferentially around shaft 12.

FIG. 2 illustrates an end view of the golf club head 16 which attaches to shaft 12 with shaft 12 being broken away for purposes of illustration. Shaft hole 42 is in the center of small trapezoid top portion 36. Faces 44 are at an angle $\phi$ with respect to the center line of shaft 12 may be within the range of 3° to 6°, but is optimum at 4°. The angle $\phi$ is not to be considered limiting to the utility of golf club 10. Angle $\phi$ determines the position that a golf ball 46 is hit and the most desirable angle $\phi$ for golfing performance is 4°. The 4° angle of the club faces permits the striking force of the club face to slightly lift the ball as it rolls forward thereby reducing the probability of excessive bounce over uneven surfaces.

FIG. 3 illustrates a front view of club head 16 with shaft 12 being broken away for purposes of illustration. The end 48 of small trapezoid top portion 36 and end 50 of large trapezoid bottom portion 38 are parallel to each other and have an angle $\phi$ with respect to the bottom 52 of head 16. Angle $\phi$ may be within the range of 5° to 10°, but is optimum at an angle of 9° for hitting a golf ball 46. The angle $\phi$ is not to be considered limiting to the utility of golf club 10.

FIG. 4 illustrates a top view of golf club 10 showing small trapezoid top portion 36 and large trapezoid bottom portion, the angle of inclination of the faces 44, and ends 48 and 50 are visable from this view.

Preferred Mode of Operation

The operation of the golf club 10 is now described with reference being made to FIGS. 1 through 4.

The geometrical shape of club head 16 of golf club 10 and handle 14 affixed to the shaft 12 permits a golfer to putt or strike a golf ball 46 with head face 44 in a direction away from the golfer while the golf ball 46 lies in a position in front of the golfer's feet.

The shape of golf club 10 enables the golfer, when in the act of striking a golf ball 46, particularly putting, to sight a direction of travel of golf ball 46 on an imaginary line to the front of the golfer. Sighting the golf ball 46 to the front of the golfer and putting it in the same direction permits the golfer to make use of his natural steroscopic vision. This enables him to naturally perceive depth of field in addition to accurately judging the distance and direction he wishes the ball to travel. The golfer therefore can choose the correct striking power and direction of his putter stroke to successfully traverse the distance to the target which could be a golf green. The shaft 12 of the golf club 10 is attached to the center of the top 40 at hole 42 of small trapezoid top portion 36 of club head 16 at a precise right angle inverted tee of 90° to insure perfect balance and equal weight distribution of the club head 16 over the entire length of the shaft 12 and circumferentially around the shaft 12.

To utilize the plumb bob cylinder assembly 20, a button shaped top portion 28 with string 32 attached to the center downward projection 30 which through a force fit retains button 28 in cylinder 20 is pulled out of center top hole 26 of cylinder 22. Cylinder 22 is force fitted into handle 14 or may be permanently affixed into handle 14 such as with glue. While supporting the weight of the golf club 10 with button 28 through string 32 protruding out through center top hole 26 of the cylinder 22 and retained by weighted ball 34 having a larger diameter than top hole 26, a plumb bob reading can be taken to determine the slope of the golfing surface such as the putting green. The plumb bob reading will be precise because the weight of the club head 16 is equally distributed over the circumference and length of the shaft 12 and handle 14 of golf club 10. The unique design of golf club 10 further allows it to be used by either right or left handed golfers as it is reversible to either without the need to change shaft 12, handle 14, or head 16.

Club head 16 may be constructed of any metal of various weight and density to accomdate a golfer's individual preferences. The weight and density factor of the club head 16 may also be varied by an addition of a combination of metals such as drilling a hole or holes in a club head 16 possibly made of aluminum or brass and filling the hole with another density of metal such as lead or a similar metal thereby not changing the basic function or utility of club head 16. The geometical balance of the golf club would also have to be observed in such a modification.

Various modifications are contemplated and may obviously be resorted to by those skilled in the art without departing from the spirit and scope of the invention, as hereinafter defined by the appended claims, as only a preferred embodiment thereof has been disclosed. Shaft 16 of golf club 10 may be bent at an angle, swivelled, or inserted into the club head at other than a 90° angle to facilitate an individual's preference to putting body postion, golf form, or golfing style. Although this disclosure is directed to a golf club, it is not be be particuarly limited to such, and the disclosed golf club 10 may be used in any activity requiring use of a club in the disclosed generic sense. It is to be understood that all matter herein described or shown in the accompanying drawings is to be interpreted as illustrative and not in a limiting sense.

The plumb bob cylinder assembly 22 can be a permanent part of golf club 10 such as by gluing it into the handle 14 or may be removable for use in another golf club handle.

Small trapezoid top portion 36 and large trapezoid bottom portion 38 may be constructed as one trapezoid accomplish the same end result as two separate trapezoids.

Having thus described the invention, there is claimed as new and desired to be secured by Letters Patent:

1. Golf club comprising a shaft, a handle means affixed to one end of said shaft, an equally balanced and geometrically shaped club head affixed to the other end of said shaft, and said club head comprising a small trapezoid top portion affixed to said shaft and a large trapezoid bottom portion affixed to said small trapezoid top portion and ends of said large trapezoid bottom portion equally spaced outwardly of ends of said small trapezoid top portion whereby said small trapezoid top portion is symmetrically and equally positioned on top of said large trapezoid bottom portion and faces of said small trapezoid top portion and said large trapezoid bottom portion align to form coplanar continuous ball striking faces providing equal weight distribution of said club head means over the entire length of and circumferentially around said shaft.

2. Golf club comprising a shaft, a handle means affixed to one end of said shaft, an equally balanced and geometrically shaped club head affixed to the other end of said shaft, said club head comprising a small trapezoid top portion affixed to said shaft and a large trapezoid bottom portion affixed to said small trapezoid top portion and ends of said large trapezoid bottom portion equally spaced outwardly of ends of said small trapezoid top portion, and a plumb bob positioned internal to said handle means comprising a cylinder, a hole in a top portion of said cylinder, a removable top portion, a downward extending member perpendicularly affixed to said removable top portion, a string attached to said downward extending member including means retaining said string internal to said cylinder whereby said removable top portion is pulled out of said cylinder internal to said handle having a diameter equal to the internal diameter of said handle to plumb a playing surface whereby said club head provides equal weight distribution over the entire length of and circumferentially around said shaft, said small trapezoid top portion is symmetrically and equal laterally positioned on top of said large trapezoid bottom portion, and faces of said small trapezoid top portion and said large trapezoid bottom portion align to form coplanar continuous ball striking faces.

3. Golf club of claim 2 wherein said removable top portion has a diameter equal to the diameter of the club handle.

4. Golf club of claim 2 wherein said retaining means comprises a weighted ball having a diameter larger than said hole in said top portion.

5. Golf club of claim 2 wherein said retaining means comprises a spring affixed between an end of said string and a bottom portion of said cylinder.

* * * * *